United States Patent [19]

Thiis-Evensen

[11] 4,188,763

[45] Feb. 19, 1980

[54] ROOFING SHINGLE

[75] Inventor: Eyvind M. Thiis-Evensen, Eidanger, Norway

[73] Assignee: Isola Fabrikker A/S, Eidanger, Norway

[21] Appl. No.: 893,974

[22] Filed: Apr. 6, 1978

[30] Foreign Application Priority Data

Apr. 14, 1977 [NO] Norway ..... 771308

[51] Int. Cl.[2] ..... E04D 1/22

[52] U.S. Cl. ..... 52/557; 52/309.6; 52/311

[58] Field of Search ..... 52/554–559, 52/543, 309.1, 309.5, 309.6, 309.12, 309.17, 311, 315, 316

[56] References Cited

U.S. PATENT DOCUMENTS

| | | | |
|---|---|---|---|
| 2,132,999 | 10/1938 | Topping | 52/557 |
| 2,302,183 | 11/1942 | Burns | 52/554 |
| 2,316,093 | 4/1943 | MacNutt | 52/559 X |
| 2,348,223 | 5/1944 | Papesh | 52/557 |
| 3,082,577 | 3/1963 | Fasold et al. | 52/543 |
| 3,407,556 | 10/1968 | Leibrook | 52/559 |

FOREIGN PATENT DOCUMENTS

| | | | |
|---|---|---|---|
| 105177 | 11/1966 | Denmark | 52/557 |

*Primary Examiner*—J. Karl Bell

*Attorney, Agent, or Firm*—Watson, Cole, Grindle & Watson

[57] ABSTRACT

Disclosed is a shingle having an enhanced relief effect which thereby simulates roofing slate or roofing tile. The enhanced relief effect is provided by covering at least a portion of the underside of the shingle with a layer of expanded particulated material such as spheres of expanded polystyrene.

11 Claims, 3 Drawing Figures

ROOFING SHINGLE

BACKGROUND OF THE INVENTION

The present invention relates to a covering element, preferably for roofs, of the type commonly known as a shingle. In the publically accessible Norwegian application No. 75.2695, a particular type of covering element is described in which a plastic film covering an asphalt layer on the underside of the shingle is further coated with a release agent.

It is common practice that covering elements of the type described in Norwegian application No. 75.2695, as well as conventional shingle types in which the plastic film is not coated with a release agent, are shaped in such a manner that the shingle will to some degree simulate roofing slate or roofing tile when mounted on a roof. The conventional shingle can be of the general type described in U.S. Pat. No. 2,963,405 and a particularly preferred embodiment is a shingle provided with "tongues" such as illustrated in FIG. 6 of U.S. Pat. No. 2,863,405. However, since the known shingle types normally have a thickness in the range 3–4 mm, they will not provide the same relief effect which can be obtained by the normally thicker roofing tiles when laid on a roof.

The present invention provides a shingle type which has a thickness such that the laid shingle will better simulate a roofing tile and hence will give an enhancement relief effect.

In Danish Pat. No. 105,177, a bituminous roofing felt is claimed, the complete underside of which is covered with a layer of porous, particulated particles of fired clay. The purpose of the particulated material is to provide ventilation in order that trapped moisture, for instance from a concrete substrate, can be permitted to escape via the channels formed by the particulated material.

SUMMARY OF THE INVENTION

As mentioned above, an object of the instant invention is to provide a shingle type which, when laid, will exhibit an improved esthetic appearance by having an enhanced relief effect.

This object is obtained by providing a layer of particulated light material on the underside surface of a shingle. For example, the particulated light material may be spheres of expanded polystyrene or a similar material having a diameter of at least 1 mm, preferably in the range of 1–6 mm.

Further objects, advantages and features of the invention will become more fully apparent from a consideration of the constituent part of the invention as set forth in the following specification taken together with the accompanying drawing.

DETAILED DESCRIPTION OF THE PREFERRED EMBODIMENT

Figure 1:
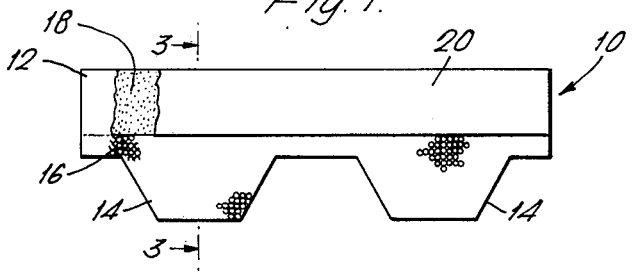
FIG. 1 is a bottom view of a preferred shingle in accordance with the present invention.

Referring now to FIG. 1, there is shown a shingle 10 which is a preferred embodiment of the present invention. Shingle 10 includes a web 12 of paper or like material impregnated with asphalt or bitumen. Web 12 has a generally rectangular shape with one or more extending three-sided tongues 14. Covering the tongues 14 and a portion of the remainder of the web 12 is a layer of spheres 16 of expanded polystyrene.

The portions of web 12 not covered by layer of spheres 16 preferably have a coating of adhesive 18 which facilitates the retention of the shingle to a roof surface. The coating of adhesive 18 may further be covered with a peelable plastic film 20 which protects the adhesive prior to installation of shingle 10.

It is preferred that only the tongues 14 of shingle 10 and that portion of the shingle which is not in contact with the roof structure be covered with a monolayer of the spheres 16, i.e., only the part of the shingle which is overlapping the underlying layer of the adjacent shingles should be covered with the spheres. Such a construction facilitates the fixing of the shingle 10 to the roof structure. However, the entire bottom surface of shingle 10 could be provided with a monolayer of spheres 16.

Figure 2:
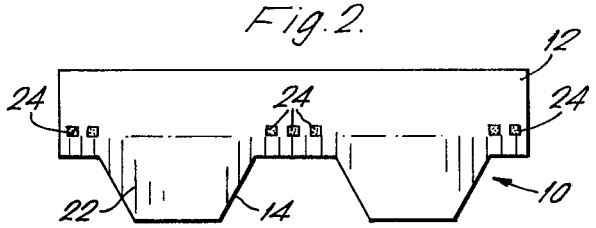
FIG. 2 is a top view of the shingle of FIG. 1.

FIG. 2 illustrates the top surface of the shingle 10 of FIG. 1. The surface of shingle 10 is provided with a pattern 22 for simulating roofing slate or roofing tile. In addition, the surface of shingle 10 has areas 24 which have an adhesive coating. The adhesive areas 24 help to secure and interlock the shingle to overlapping shingles when the shingle is installed on a roof.

Figure 3:
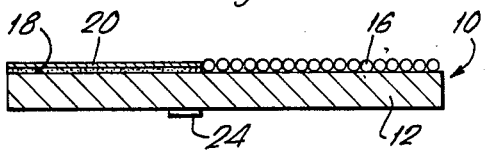
FIG. 3 is an enlarged cross-sectional view of the shingle of FIG. 1 taken along line 3—3.

FIG. 3 is a cross-sectional view of the shingle of FIG. 1 along line 3—3. The cross-sectional view is of course not drawn to scale in order to more clearly show the construction of shingle 10. Shingle 10 includes web 12 and the layer of spheres 16 on a portion of the one surface of the web. On the remaining portion of this surface of the shingle 10 are the adhesive coating 18 and the peelable plastic film 20. On the other surface of web 12 is an area of adhesive 24.

In addition to improving the esthetic appearance of the laid shingles, a layer of, for instance, expanded polystyrene spheres will also improve the insulating properties of the laid roof as shingles usually are laid with approximately 50% overlap. The improved insulation can be of importance in countries with cold winter climate. Furthermore, the monolayer of the expanded spheres will also reduce the noise caused by heavy rain. Thus, by providing shingles with a monolayer of spherical material such as expanded polystyrene with the above-mentioned diameter, it is possible to increase the "effective" thickness of a portion of the shingle without a significant increase in the weight of the shingle. The most effective relief effect is obtained when using dark colored spheres such as black spheres.

While there has been shown and described what is considered to be a preferred embodiment of the present invention, it will be obvious to those skilled in the art that various changes and modifications may be made therein without departing from the invention as defined in the appended claims.

I claim:

1. A roofing shingle comprising a web having at least one tongue, the top surface of the web having a pattern which simulates roofing slate or roofing tiles, the bottom surface of the web having a monolayer of particulated material having a diameter of at least 1 mm covering at least a portion of the tongue, the particulated material comprising spheres of an expanded plastic material.

2. A roofing shingle according to claim 1, wherein the spheres are of a darkly colored expanded polystyrene.

3. A shingle according to claim 1, wherein the portion of the bottom surface of the web not having a layer of particulated material has an adhesive coating.

4. A shingle according to claim 3, wherein the web is impregnated with a material selected from asphalt and bitumen or mixtures thereof.

5. A shingle according to claim 3, wherein the adhesive coating is coated with a plastic film.

6. A shingle according to claim 5, wherein the top surface of the web is provided with areas of an adhesive coating adapted for securing and interlocking the shingle to adjacent shingles when laid.

7. A roofing shingle according to claim 6, wherein the spheres are of a darkly colored expanded polystyrene.

8. A shingle according to claim 1, wherein the particulated material has a diameter in the range of 1 to 6 mm.

9. A shingle according to claim 1, wherein the portion of the web covered by the monolayer is that which, when laid on a roof, overlaps an underlying shingle.

10. A shingle according to claim 1, wherein the monolayer of particulated material covers the tongue.

11. A single according to claim 10, wherein the monolayer of particulated material covers a portion of the remainder of the web.

* * * * *